US009022089B1

(12) United States Patent
Dau

(10) Patent No.: US 9,022,089 B1
(45) Date of Patent: May 5, 2015

(54) WINDOW WITH RETRACTABLE BARRIER ASSEMBLY

(71) Applicant: William S. Dau, Groveland, FL (US)

(72) Inventor: William S. Dau, Groveland, FL (US)

( * ) Notice: Subject to any disclaimer, the term of this patent is extended or adjusted under 35 U.S.C. 154(b) by 0 days.

(21) Appl. No.: 14/281,282

(22) Filed: May 19, 2014

Related U.S. Application Data

(60) Provisional application No. 61/825,260, filed on May 20, 2013.

(51) Int. Cl.

| | |
|---|---|
| ***E06B 9/17*** | (2006.01) |
| ***E06B 9/54*** | (2006.01) |
| ***E06B 9/52*** | (2006.01) |
| ***E06B 3/42*** | (2006.01) |
| ***E06B 7/14*** | (2006.01) |

(52) U.S. Cl.
CPC . *E06B 9/54* (2013.01); *E06B 9/522* (2013.01); *E06B 3/42* (2013.01); *E06B 7/14* (2013.01); *E06B 2009/527* (2013.01); *E06B 9/17023* (2013.01)

(58) Field of Classification Search
USPC ..... 160/30, 27, 28, 29, 99, 100, 290.1, 288, 160/289, 281, 280, 275, 44, 41, 24
IPC ..... E06B 9/17007,9/17015, 9/17023, 9/1703, E06B 2009/1708, 2009/546
See application file for complete search history.

(56) References Cited

U.S. PATENT DOCUMENTS

| | | | | |
|---|---|---|---|---|
| 611,924 | A * | 10/1898 | Monroe | 160/30 |
| 1,232,803 | A * | 7/1917 | Housteau | 160/23.1 |
| 2,539,122 | A * | 1/1951 | Ditta | 160/30 |
| 2,605,823 | A * | 8/1952 | Lockhart | 160/30 |
| 2,825,400 | A * | 3/1958 | Poulsen | 160/30 |
| 3,008,518 | A * | 11/1961 | Hayes | 160/27 |
| 4,197,896 | A * | 4/1980 | Reichstadt | 160/107 |
| 4,651,797 | A | 3/1987 | Lange | |
| 6,230,782 | B1 * | 5/2001 | Reichert | 160/32 |
| 6,446,696 | B1 | 9/2002 | Davies et al. | |
| 6,470,947 | B1 * | 10/2002 | Holevas | 160/28 |
| 6,618,988 | B2 | 9/2003 | Williams et al. | |
| 6,679,002 | B2 | 1/2004 | Davies et al. | |
| 6,814,127 | B2 | 11/2004 | Tagtow et al. | |
| 7,080,676 | B2 * | 7/2006 | Abelson et al. | 160/30 |
| 2005/0022943 | A1 | 2/2005 | Thomas et al. | |
| 2005/0081463 | A1 | 4/2005 | Allen et al. | |
| 2007/0227676 | A1 | 10/2007 | Legay | |
| 2007/0284052 | A1 | 12/2007 | Thomas et al. | |
| 2010/0229468 | A1 | 9/2010 | Allen et al. | |

OTHER PUBLICATIONS http://www.phantomscreens.com/products/window/ Accessed Jan. 18, 2013.
http://geniusscreens.com/products/windows.php Accessed Jan. 18, 2013.

* cited by examiner

*Primary Examiner* — David Purol
(74) *Attorney, Agent, or Firm* — Robert C. Montgomery; Montgomery Patent & Design LP

(57) ABSTRACT

A retractable flexible screen is attached to a retractable barrier assembly fitted into a bottom edge portion of a window sash portion of a window unit. The retractable barrier assembly is provided with a weather seal and a moisture draining means. A weather strip is provided along a bottom edge of the screen. The screen is maintained in a retracted position within the retractable barrier assembly until it is desired to employ the screen. To deploy the screen, it is extracted from the retractable barrier assembly and a bottom edge is anchored against a sill portion of the window unit, thereby causing the screen to be automatically extended each time the sash is raised.

20 Claims, 8 Drawing Sheets

WINDOW WITH RETRACTABLE BARRIER ASSEMBLY

RELATED APPLICATIONS

The present invention was first described in and claims the benefit of U.S. Provisional Application No. 61/825,260, filed May 20, 2013, the entire disclosures of which are incorporated herein by reference.

FIELD OF THE INVENTION

The present invention relates to a window unit with a retractable bather assembly extending from an edge of a sliding window sash.

BACKGROUND OF THE INVENTION

Window units come in a variety of shapes and configurations. A common window unit style is the sliding sash window system. This system has two (2) sashes that overlap slightly and slide up/down or left/right inside the frame of the window. A disadvantage of these systems is that the window opening is either left without a screen or the screen is a stationary rectangular member that must be removed completely from the frame in the event that one does not want the screen in place. If left in place, and when the window is in a closed position, a user is left with an unsightly screen mesh in the background of the viewing window pane. One viewing through the closed window cannot help but notice the mesh screen in the background, which usually collects dust, dirt, and grime. Additionally, the screen is continuously left exposed to bear the elements of inclement weather, which provides ample opportunity for the screen to become damaged. An additional disadvantage of current window systems is that the screen frame fails to form a proper seal, which leaves a gap through which insects may enter. Moreover, existing window systems dictate the use of an additional track through which a screen must engage to operate, thus leaving an additional member to collect dirt and grime. Accordingly, there is a need to provide a means by which a screen can be incorporated within a window sash so as to be extendable and retractable within the framework of the sash at the discretion of the user. The development of the retractable barrier assembly fulfills this need.

The present invention is a sliding sash window system having at least one (1) sash equipped with a retractable barrier assembly within the framework of the sash. This retractable barrier assembly selectively provides a barrier, preferably a screen, to the opening of the window when the sash is in an open position. Yet, this barrier may be retracted into the framework of the sash itself when no barrier is desired. Furthermore, when the sash is in a closed position, the barrier is neatly and compactly stored within the frame of the sash, concealed from view and protected from the elements. The window system is further configured to enable the barrier to automatically extend and retract as the sash is opened and closed, as desired. The retractable barrier assembly is further configured to enable quick and easy access for maintenance purposes.

Prior art in this field consists of window and door constructions with retractable screen assemblies but these assemblies do not afford the ability to open the window without creating a barrier that is the screen. Consequently, a user must have the opening obstructed with the screen or the window pane. Furthermore, none of the prior art devices enable easy access and removal of the retractable screen assemblies for maintenance and replacement purposes.

It is an objective of the present invention to provide a window unit employing a sliding sash system having a retractable barrier assembly incorporated within the framework of at least one (1) sash and create an obstruction to an opening created by the operation of the sash by extending a barrier from the retractable barrier assembly and removably securing it in place by a retention mechanism.

It is a further objective of the present invention to configure the retractable barrier assembly to operate in conjunction with the sash so as to be an extension of the sash while the sash is in operation and to not be a conspicuous portion of the window unit.

It is a further objective of the present invention to provide the window unit and retractable barrier assembly without the need for a track through which the barrier must traverse in order to operate smoothly and effectively.

It is a further objective of the present invention to configure the window unit so as to conceal the retractable barrier assembly within the framework of the sash with the use of a containment plate.

It is a further objective of the present invention to enable easy access and removal of the retractable barrier assembly for maintenance and replacement thereof.

It is a further objective of the present invention to configure a retention mechanism so as to enable a user to selectively obstruct the opening of the window with the barrier only when it is desired to create such an obstruction while the sash is in an open position.

It is a further objective of the present invention to configure the retention mechanism to bias the barrier laterally so as to create a proper and adequate seal against weatherproofing members of the window frame when the barrier is deployed.

It is a further objective of the present invention to provide additional weatherproofing and water drainage for the retractable barrier assembly to ensure water is not contained within the assembly in case water infiltration does occur.

SUMMARY OF THE INVENTION

The present invention is a window unit with a retractable barrier assembly that extends from an edge of a window sash of the window unit. It is envisioned for the window unit to comprise at least one (1) sash that is configured to slide within a frame of the window unit to selectively create an opening or an obstruction through the window unit. The retractable barrier assembly is housed within the framework of the sash so as to not detract from the aesthetics of the window sash, or even be conspicuous as to its presence. The retractable barrier assembly includes a spool about which a barrier, preferably a screen mesh, is wound. As the sash is slid away from a sill or frame portion of the window unit, an opening is created. This opening can be screened off by pulling the barrier from the retractable screen assembly and removably securing the barrier to a portion of the window frame via retainers. Alternatively, the barrier can be removably secured to the retainers whether the sash is closed or open so as to automatically screen off the opening as the sash is opened and closed.

A containment plate is disposed on an edge of the sash to cover and conceal the retractable barrier assembly, but this containment plate is removable to grant access to the retractable barrier assembly. The containment plate is further provided with a seal to facilitate a weatherproofing connection between the containment plate and the window frame and/or window sill as the sash is slid to a closed position. The retractable barrier assembly is also removably secured to the interior framework via brackets. Actuation of the brackets releases the retractable barrier assembly, which is then slid from the framework to be maintenanced or replaced. The window frame has outer flanges, each having weather strips to mechanically bond or attract to the barrier so as to provide additional weatherproofing when the barrier is in a deployed, or extended, state.

A distal end of the barrier is provided with a stiffener edge, a weather strip, and a pair of retainers. The stiffener edge facilitates manipulation of the barrier about the window unit and provides added rigidity to the barrier when in an extended state. Each retainer is further paired with complementary retainers affixed to portions of the window frame. The complementary retainers are envisioned to be male and female interlocking retainers, which position the weather strip in a stationary manner against a sill plate of the window unit and the barrier against the weather strips of the outer flanges when the barrier is deployed. Yet, each retainer enables detachment of the barrier to allow the retractable barrier assembly to wind up the barrier to provide a normal window opening, when desired. While the retainers are interconnected, they bias the stiffener edge and the barrier laterally against the respective outer flange weather strips.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
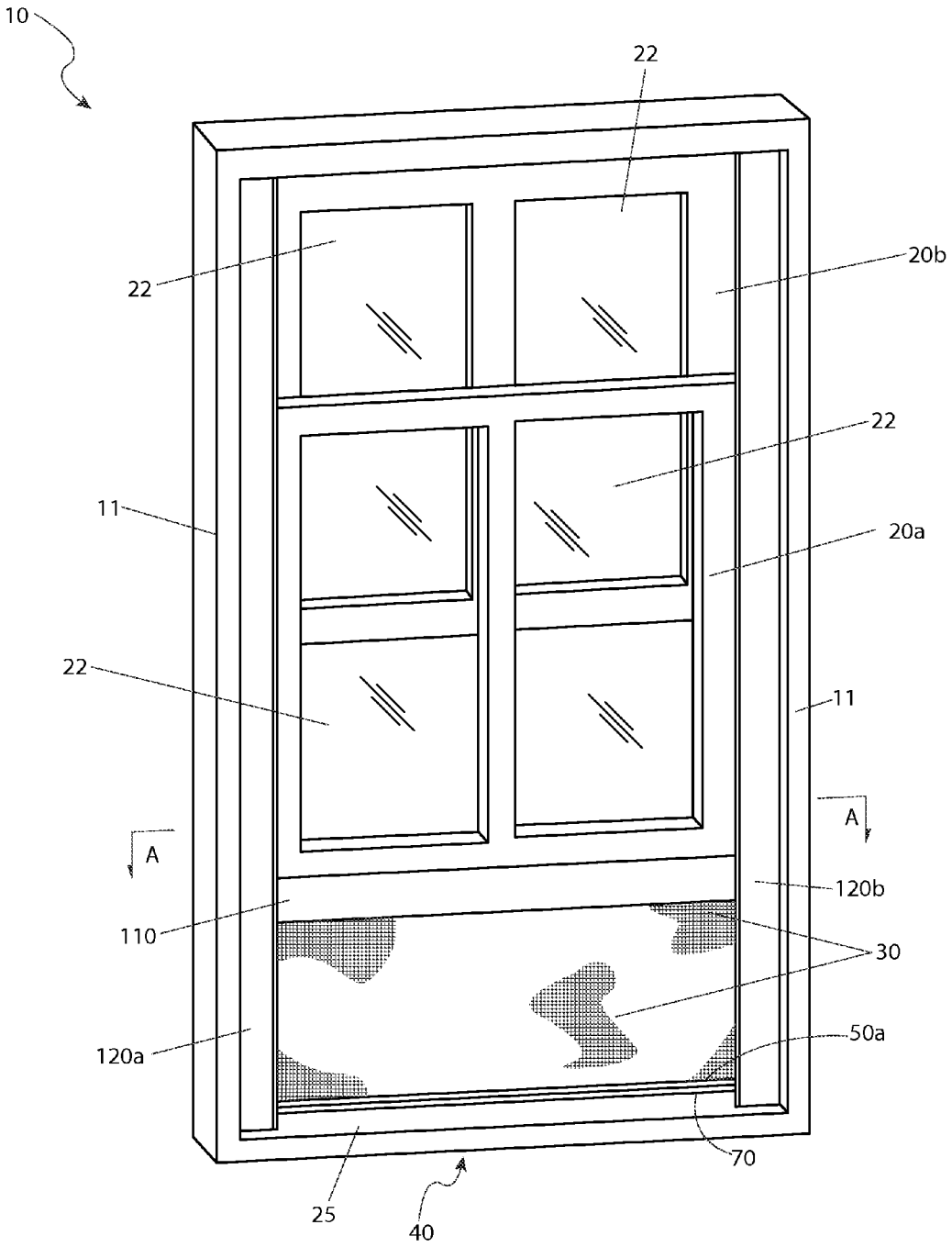
FIG. 1 is a frontal environmental view of a window 10 with retractable barrier assembly 40 in a partially open state, according to a preferred embodiment of the present invention.

10 window
11 window frame
20*a* lower window sash
20*b* upper window sash
22 windowpane
25 sill plate
30 screen
40 retractable barrier
50 stiffener
50*a* first stiffener half
50*b* second stiffener half
52*a* post
52*b* socket
60 bottom seal
70 first weather strip
80 second weather strip
90 retainer assembly
91 male retainer
92 retainer tab
93 retainer post
96 female retainer
97 anchor
98 groove
99 slot
100 containment plate
110 housing
112 first appendage
113 second appendage
120*a* first inner flange
120*b* second inner flange
122*a* first outer flange
122*b* second outer flange
140 drain aperture
150 axle
152*a* first bracket
152*b* second bracket
160 spool
170 torsion spring
200 fastener
202 fastener aperture

DETAILED DESCRIPTION OF THE PREFERRED EMBODIMENT

The best mode for carrying out the invention is presented in terms of its preferred embodiment, herein depicted within FIGS. 1 through 6*c*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a window unit 10 with a retractable bather assembly 40 that extends downwardly from a lower window sash 20*a*, which provides a means to fence a window opening by extending a screen 30 section from a retracted position within the lower window sash 20*a*.

Figure 2:
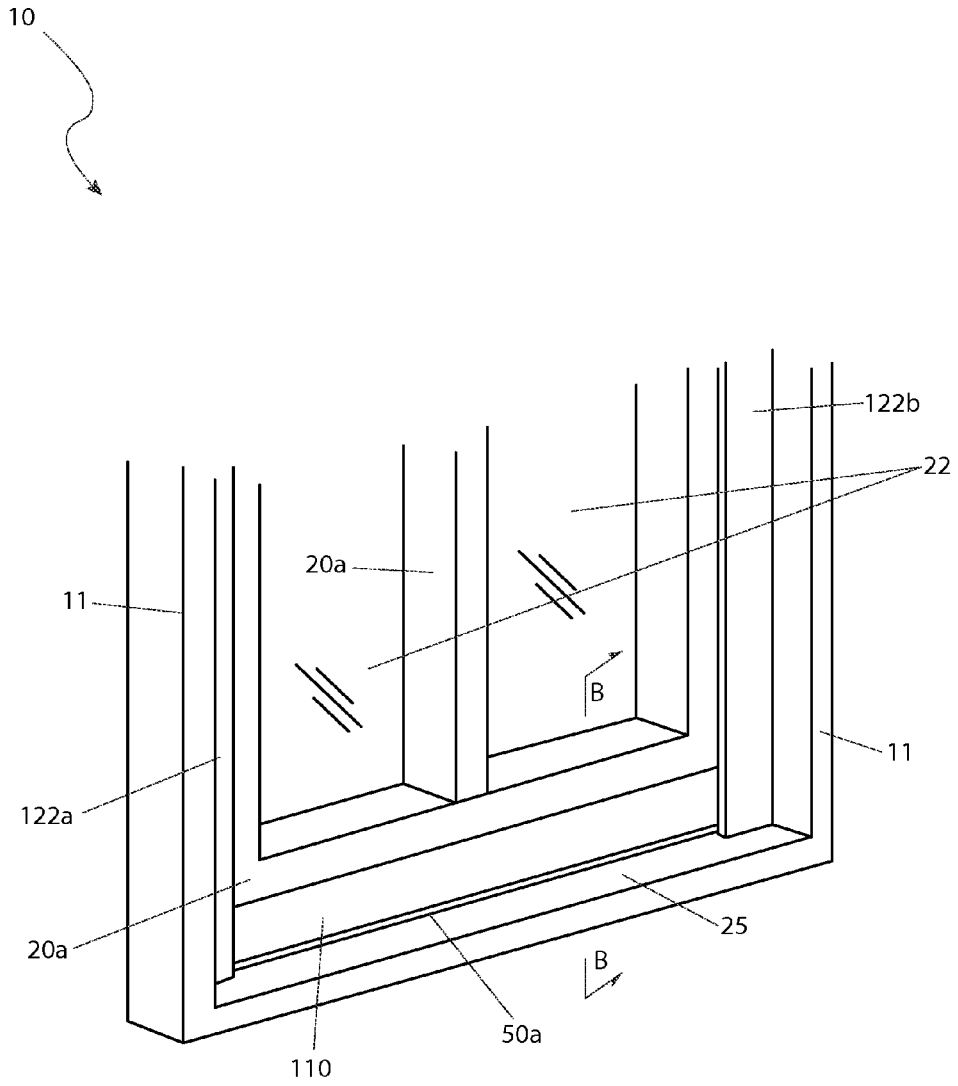
FIG. 2 is another frontal environmental view of the window 10 with retractable barrier assembly 40 in a closed state, according to a preferred embodiment of the present invention.

Referring now to FIGS. 1 and 2, frontal environmental views depicting partially open and closed states of the barrier assembly 40 as viewed from inside and outside a building structure, respectively, according to a preferred embodiment of the present invention, are disclosed. A window frame 11 having a lower window sash 20*a* and an upper window sash 20*b* that slide within and are positioned between flanges including first inner flange 120*a* and second inner flange 120*b* portions along opposing portions of an exterior side, and first outer flange 122*a* and second outer flange 122*b* portions along opposing portions of an interior side.

The lower 20*a* and upper 20*b* window sashes comprise rectangular casings enclosing at least one (1) windowpane 22, wherein the window sashes 20*a*, 20*b* are envisioned to be fabricated from a rigid polymer material; however, it is understood that other materials and configurations may be utilized without deviating from the teachings of the window 10, and as such should not be interpreted as a limiting factor of the window 10. The lower 20*a* and upper 20*b* window sashes are employed within a window frame 11 to facilitate a friction-type sliding window unit 10. An embodiment of the lower 20*a* and upper 20*b* window sashes is shown here providing a vertical sliding motion; however, it is understood that the sashes 20*a*, 20*b* may also be configured for horizontal motioning while retaining the teachings of the present invention and as such should not be interpreted as a limiting factor of the window 10.

Figure 3:
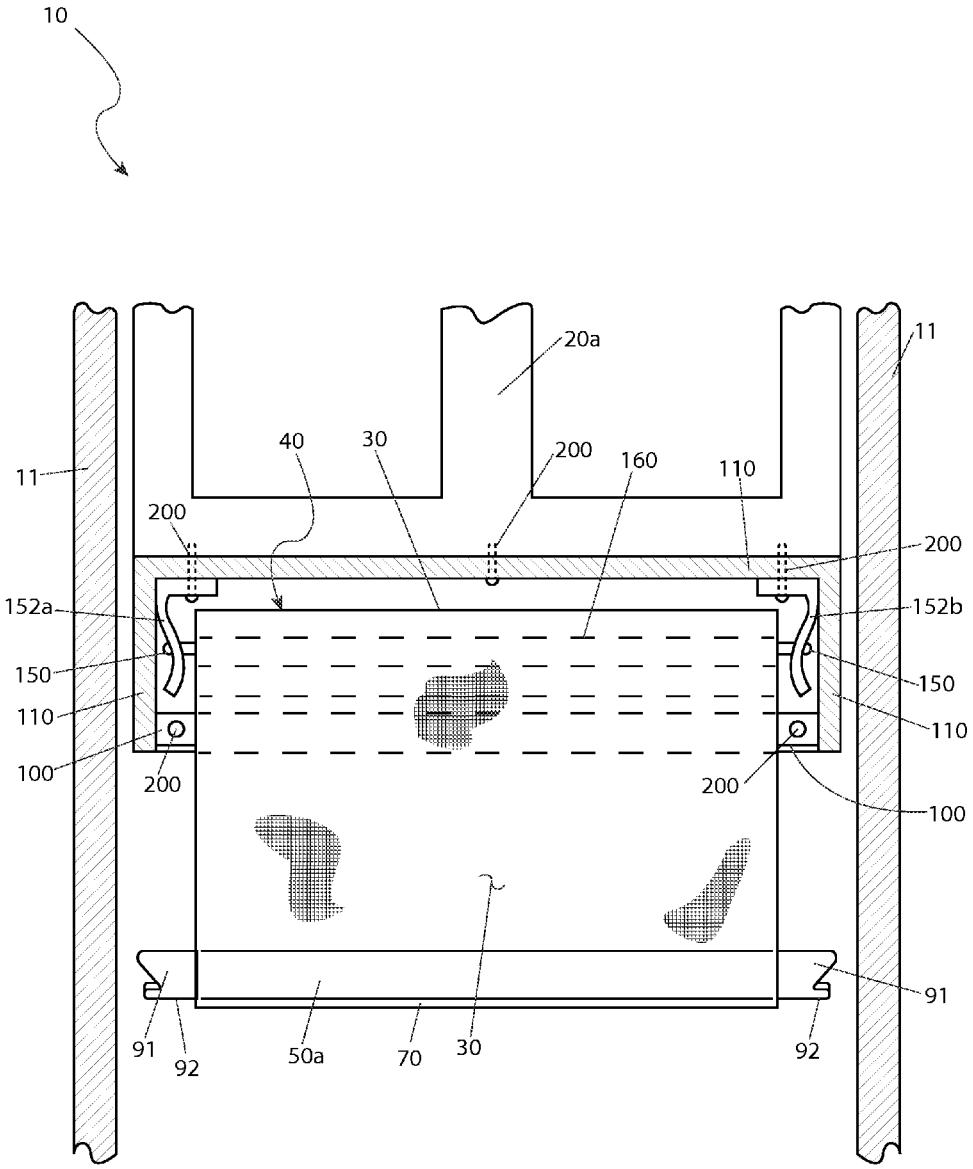
FIG. 3 is a front sectional view of the retractable barrier assembly portion 40 taken along section line A-A (see FIG. 1), according to a preferred embodiment of the present invention.

The lower window sash 20*a* includes a retractable barrier assembly 40 positioned within a housing portion 110 being affixed along a bottom surface of the lower window sash 20*a* using a plurality of fasteners 200 (also see FIG. 3). Upon raising the lower window sash 20*a*, a screen 30 is dispensed from the housing 110 to cover the resulting window opening. The screen 30 includes attached stiffener edge 50 and first weather strip 70 portions along a bottom edge which secure and seal the screen 30 against a sill plate portion 25 of the window frame 11.

Figure 4:
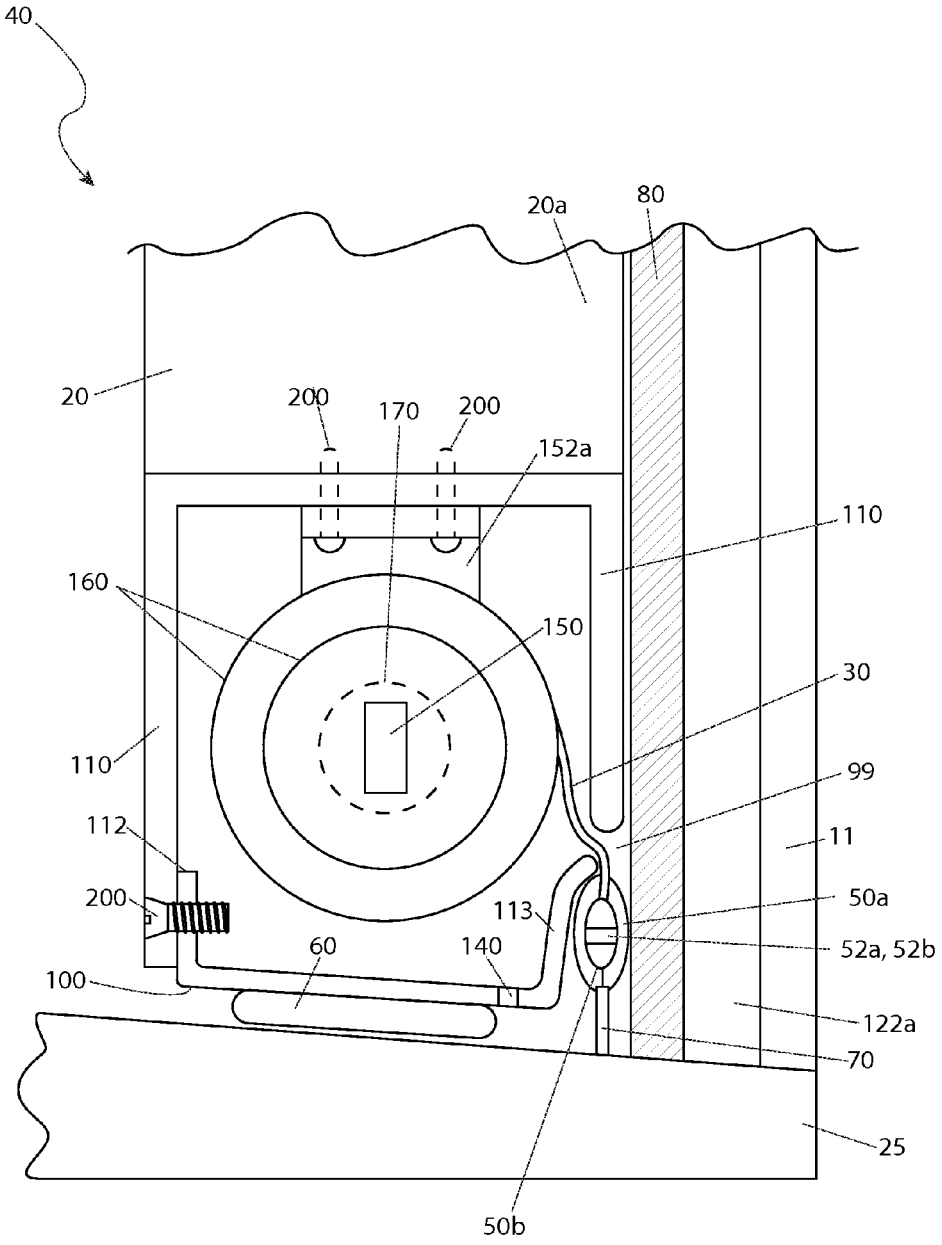
FIG. 4 is a side sectional view of a retractable barrier assembly 40 portion taken along section line B-B (see FIG. 2), according to a preferred embodiment of the present invention.

Referring now to FIGS. 3 and 4, front sectional and side sectional views of the retractable barrier assembly portion 40, according to a preferred embodiment of the present invention, is disclosed. The retractable barrier assembly 40 is shielded discreetly within a three-sided housing 110 and a bottom covering containment plate 100 from which a retractable screen 30 may extend downwardly through a slot portion 99. The retractable barrier assembly 40 retracts and stores the screen 30 within the space defined by the housing 110 and containment plate 100. The retractable barrier assembly 40 provides a means to apply a constant tension upon, and automatically roll up a length of screen 30 into the housing 110 in a discrete and hidden manner as the lower window sash 20*a* is raised and lowered. The containment plate 100 provides a channel-shaped form including a perpendicular first appendage 112 along one (1) longitudinal edge which provides a means to mount the containment plate 100 to the housing 110, and a second appendage 113 along an opposing edge which forms the slot 99, which works in conjunction with an adjacent bottom longitudinal edge of the housing 110 to form the slot 99 through which the screen 30 is routed (also see FIG. 5).

The retractable barrier assembly 40 is mounted to an inner top surface of the housing 110 via a first bracket 152*a* and an opposing second bracket 152*b* which engage respective opposing ends of an axle portion 150 of the retractable barrier assembly 40. The rod-shaped axle 150 is centered in a freely-rotating manner within a cylindrical spool portion 160 which in turn contains a torsion spring 170. The embodiment of the retractable barrier assembly 40 shown here is similar to that of a common window shade; however, it is understood that other recoil methods may be utilized without deviating from the present teachings, and as such should not be interpreted as limiting factors. The axle 150 is attached to the first bracket 152*a* in a non-rotating manner. The torsion spring 170 is located internal to the spool 160 having one (1) end affixed to the axle 150 and an opposing end portion attached to the spool 160, thereby applying a torsion upon the spool 160 which keeps a constant tension upon the screen 30.

At least one (1) of the brackets 152*a*, 152*b* is envisioned to be made using a spring steel material to enable outward deflection thereof to allow the removal of the retractable barrier assembly 40 if the need to replace the retractable barrier assembly 40 or the screen 30 arises.

The housing 110 provides a matching outline and acts as a downward extension of the lower window sash 20*a*. When the lower window sash 20*a* is configured in a vertical sliding orientation, the housing 110 extends downwardly from a lower edge of the lower window sash 20*a*.

The open bottom side of the housing 110 is provided with a removable containment plate 100. The containment plate 100 is attached to the housing 110 via the first appendage 112 and a plurality of fasteners 200, such as screws, along a rear surface, thereby enabling the containment plate 100 to be removably attached to the housing 110. It is envisioned that the fasteners 200 utilize a plurality of apertures 202 and screws to secure the containment plate 100 to the housing 110. The housing 110 and containment plate 100 are envisioned to be made of a similar material as the window sashes 20*a*, 20*b* (also see FIG. 5).

Whenever the need arises to perform maintenance, the containment plate 100 can be removed by removing the fasteners 200 to grant access to the retractable bather assembly 40. The retractable barrier assembly 40 may then be removed from the housing 110 by actuation of the first bracket 152*a* (see FIG. 3). The first 152*a* and second 152*b* brackets are again employed to reinstall the retractable barrier assembly 40 after maintenance or replacement of the screen 30 and/or retractable barrier assembly 40 is performed.

Figure 6A:
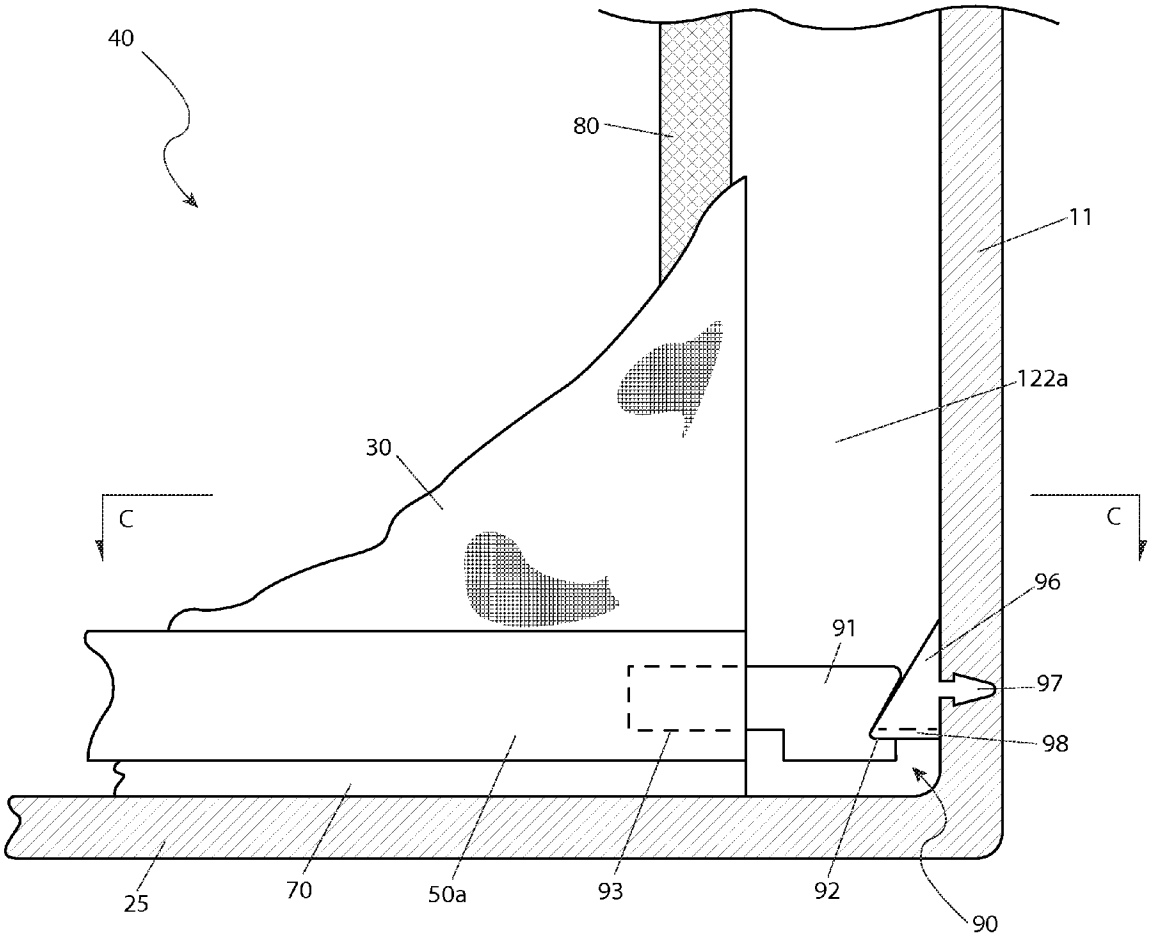
FIG. 6*a* is a close-up side view of a retainer assembly portion 90 of the bather assembly 40, according to a preferred embodiment of the present invention.
Figures 6B, 6C:
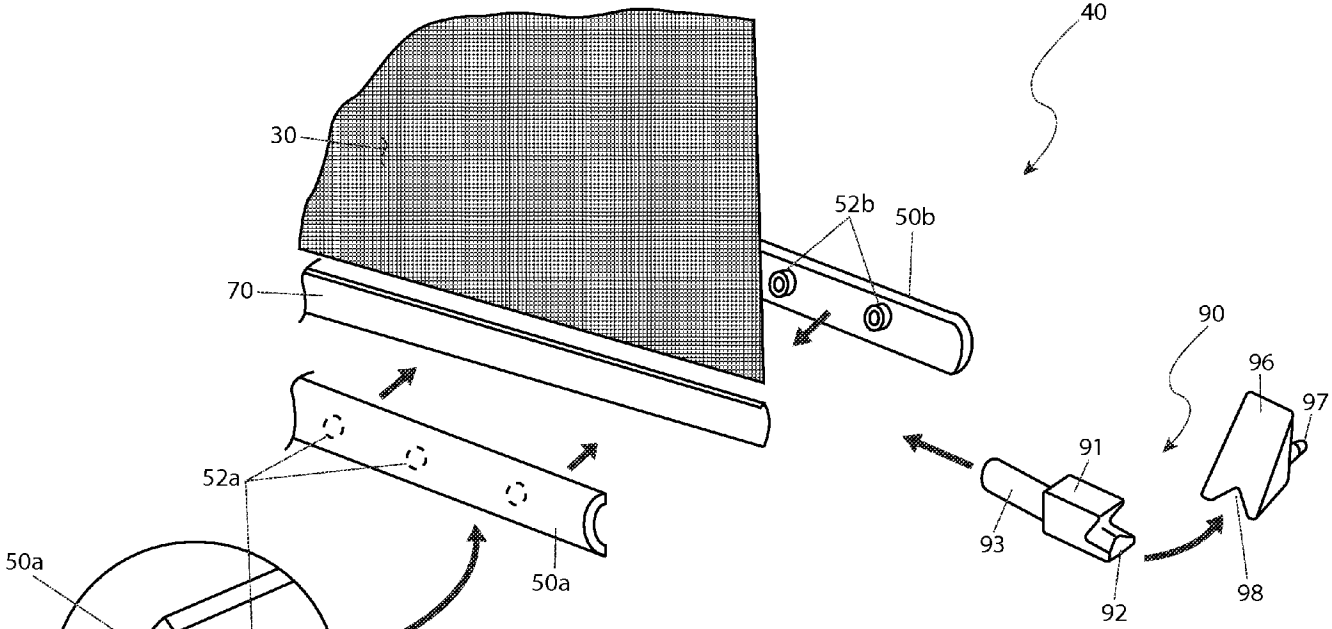
FIG. 6*b* is an exploded view of the retainer assembly portion 90 of the window with retractable barrier assembly 40, according to a preferred embodiment of the present invention.
FIG. 6*c* is an exploded view of the retainer assembly portion 90 of the window with retractable barrier assembly 40, according to a preferred embodiment of the present invention; and, FIG. 6*d* is a close-up view of the post portion 52*a* of the first stiffener half 50*a* of the retractable barrier assembly 40, according to a preferred embodiment of the present invention.
Figure 6D:
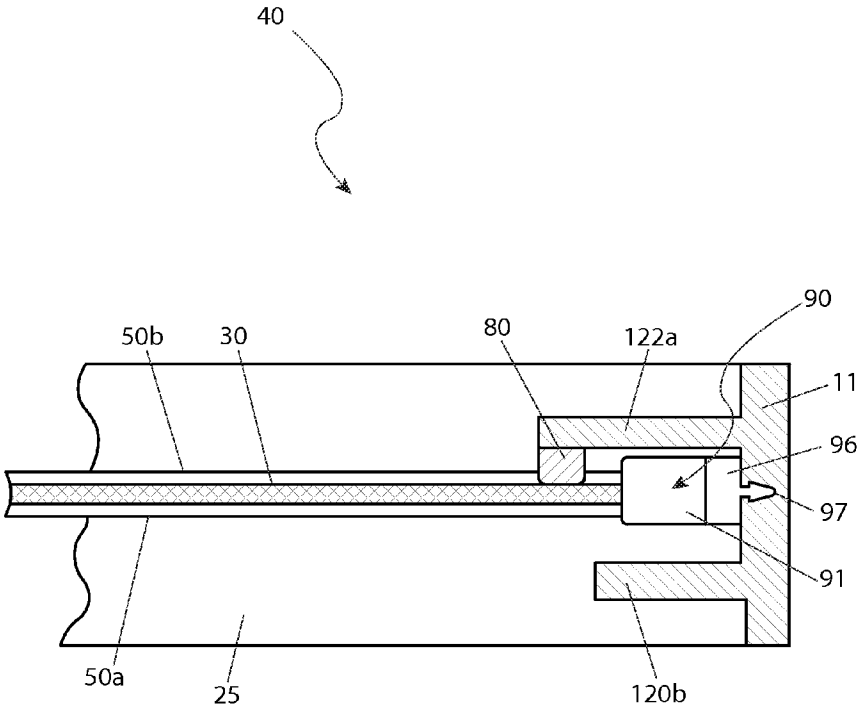

The screen 30 is provided with a stiffener edge 50, a first weather strip 70, and a pair of retainer assemblies 90 (see FIGS. 6*a* through 6*c*).

Figure 5:
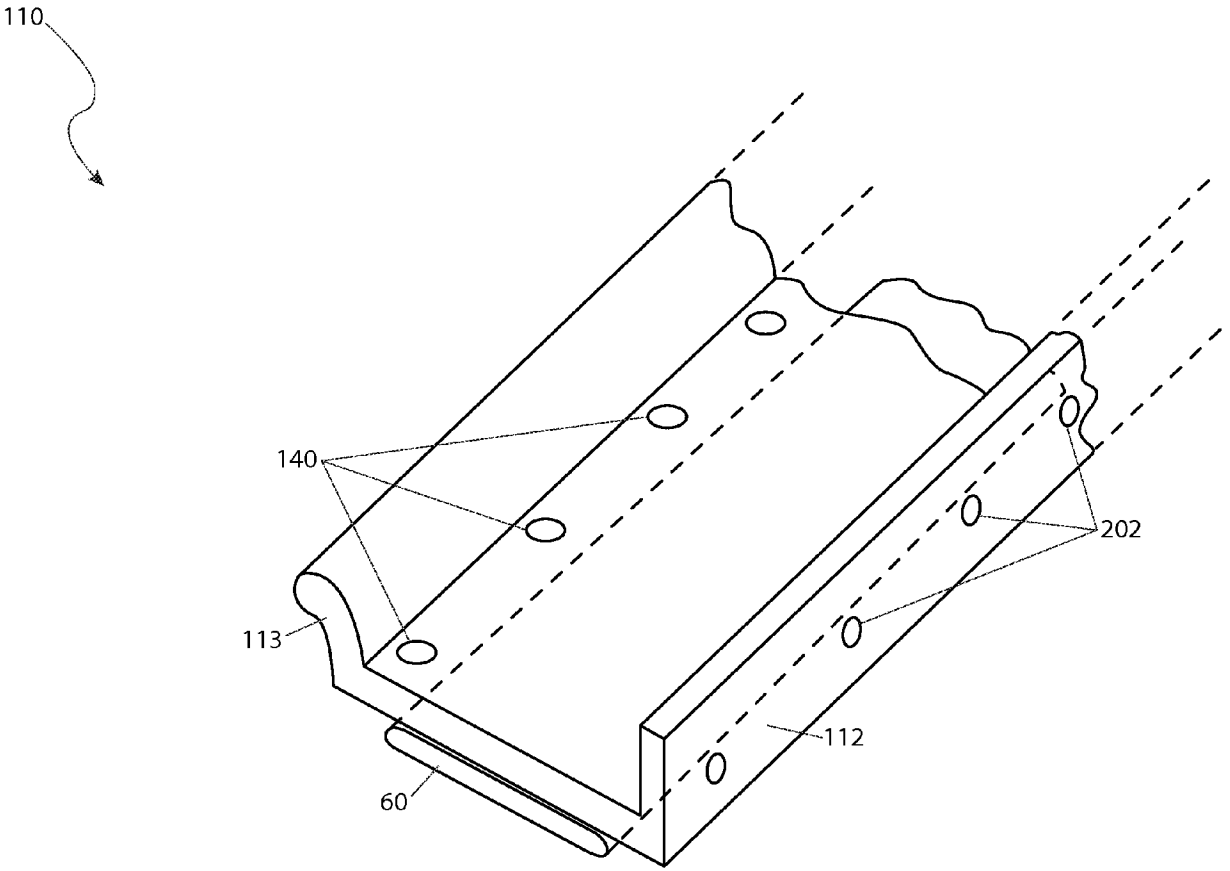
FIG. 5 is a partial perspective view of a containment plate 100 portion of the retractable barrier assembly 40, according to a preferred embodiment of the present invention.

Referring now to FIG. 5, a partial perspective view of the containment plate portion 100, according to a preferred embodiment of the present invention, is disclosed. The containment plate 100 provides a channel-shaped form which covers and contains a bottom portion of the housing 110 to provide containment of the retractable barrier assembly 40 (see FIGS. 3 and 4). The upwardly protruding first appendage 112 of the containment plate 100 includes a plurality of fastener apertures 202 used to mount the containment plate 100 to the housing 110 using fasteners 200 (see FIG. 4). The upwardly protruding second appendage 113, together with the housing 100, act to form the slot 99 through which the screen 30 is routed.

Additionally, a bottom seal 60 is adhesively bonded, or otherwise affixed, along a bottom surface of the containment plate 100 to facilitate a weatherproof connection between the containment plate 100 and the subjacent sill plate portion 25 of the window frame 11 when the lower window sash 20*a* is in a closed state (see FIG. 4). The bottom seal 60 is envisioned to comprise a flexible rubber or synthetic rubber polymer material; however, it is understood that other materials exhibiting equivalent insulating and sealing properties may be utilized without deviating from the present teachings, and as such should not be interpreted as limiting factors. The containment plate 100 is envisioned to include a slightly sloping bottom surface intended to be generally parallel to that of the sill plate 25, including a plurality of drain apertures 140 arranged along a lowest corner portion to assist in draining moisture (see FIG. 4).

Referring now to FIGS. 6*a* through 6*d*, close-up, exploded, and top sectional views of the retainer assembly portion 90, according to a preferred embodiment of the present invention, are disclosed. Each outer flange 122*a*, 122*b* is provided with a second weather strip 80 along a vertical peripheral edge thereof. It is envisioned that the second weather strip 80 provides a pile-type or hook-and-loop-type section of weather stripping material adhesively, or otherwise affixed to the outer flanges 122*a*, 122*b*. Each second weather strip 80 is envisioned to provide effective mechanical bonding or attraction to the screen 30; however, it is understood that other materials and configurations may be utilized without deviating from the present teachings, and as such should not be interpreted as limiting factors. Each outer flange 122*a*, 122*b* is integrated into, and protrudes perpendicularly from an inside surface of the window frame 11 so as to have the second weather strip 80 face toward the lower window sash 20*a*, being positioned so as to abut against the lower window sash 20*a*, the stiffener edge 50, and the screen 30 as seen in FIG. 6*c*. Each outer flange 122*a*, 122*b* is envisioned to be made using the same material as the window sashes 20*a*, 20*b*.

The screen 30 is envisioned to be fashioned from a flexible polymer material and forms a netting surface with a mesh size capable of providing exclusion of debris and insects; however, it is understood that other materials and configurations may be utilized without deviating from the present teachings, and as such should not be interpreted as limiting factors. The screen 30 extends from the spool 160 and protrudes through the slot 99 between the housing 110 and the containment plate 100 (see FIGS. 3 and 4). One (1) edge of the screen 30 is permanently affixed to the spool portion 160 of the retractable barrier assembly 40. The extended edge of the screen 30 is provided with a two-part stiffener edge 50 including arcuate first stiffener half 50*a* and second stiffener half 50*b* portions which join in a clamshell manner to entrap the screen 30 between upper joining edges and the first weather strip 70 between lower joining edges. Furthermore, the stiffener halves 50*a*, 50*b* are "snapped" together to form an oval-shaped form by engaging respective integrally-molded post 52*a* and socket 52*b* features. This oval-shape prevents the screen 30 from retracting into the housing 110 because it is larger in size than that of the slot 99. The stiffener edge 50 facilitates manipulation of the screen 30 about the window 10 and provides added rigidity to the screen 30 structure when in an extended state. Either stiffener half 50*a*, 50*b* can comprise the post feature 52*a* or socket feature 52*b*.

The first weather strip 70 provides an effective barrier from insects, debris, and the like, and is envisioned to comprise a flexible rubber or polymer blade structure, or a whisker-like barrier; however it is understood that other materials may be utilized without deviating from the present teachings, and as such should not be interpreted as limiting factors.

The stiffener edge 50 may be selectively anchored to the window frame 11 so as to allow the screen 30 to be dispensed as the lower window sash 20*a* is raised.

The stiffener edge portion 50 of the screen 30 is anchored by affixing a pair of retainer assemblies 90 located on each end portion of the stiffener edge 50.

Each retainer assembly 90 include interlocking portions comprising a male retainer 91 which is affixed to the stiffener edge 50, and a female retainer 96 which is attached to the window frame 11. The male 91 and female 96 retainers provide interlocking features which position the first weather strip 70 in a stationary manner against the sill plate 25, and the screen 30 against the second weather strip 80, while enabling detachment of the retainer assemblies 90 by a user to allow the retractable barrier assembly 40 to wind up the screen 30 to provide a normal window opening, when desired. The male retainer 91 provides a rectangular form having integrally-molded portions including a protruding triangular retainer tab 92 at a distal end, and a cylindrical retainer post 93 at a proximal end. During assembly, the half portions 50*a*, 50*b* of the stiffener act to clamp onto and position a retainer post 93 at each end portion. The female retainer portion 96 provides a wedge-shaped form having integrally-molded features for securement to the window frame 11 and removable attachment to the male retainer 91 including respective anchor 97 and groove 98 portions. The anchor 97 is inserted and secured within a mating aperture portion along an inner surface of the window frame 11 via a press fit. The groove 98 is located along a bottom surface of the female retainer 96 being sized and shaped to receive and center the aforementioned retainer tab 92 within. In use, the retainer tab 92 is held within the groove 98 by the tension being applied to the screen 30 by the retractable barrier assembly 40. To detach the retainer tab 92 from the groove 98, a user presses downwardly upon the stiffener edge 50, slightly compressing the bottom seal 60 and first weather strip 70 portions, and then motions the male retainers 91 laterally away from the respective female retainers 96.

While the retainer tabs 92 are seated within respective grooves 98, the retainer assemblies 90 act to bias the stiffener edge 50 and the screen 30 laterally against the respective second weather strips 80. This bias towards each second weather strip 80, as well as the tension which causes the screen 30 to be in a taut condition, assists in forming a secure bather between the screen 30 and window opening.

In use, a user installs the window 10 into a window opening in a conventional manner, and secures the retainer tabs 92 into the grooves 98 to establish contact and a mechanical bond between the screen 30 and the outer flanges 122*a*, 122*b*. When the lower window sash 20*a* is in a closed position, the lower window sash 20*a* effectively closes off the window opening with the bottom seal 60, thereby facilitating a proper abutment between the lower window sash 20*a* and the sill plate 25. The first weather strip 70 of the stiffener edge 50 simultaneously provides additional sealing between the stiffener edge 50 and the sill plate 25. When the lower window sash 20*a* is in an open position, the retractable barrier assembly 40 may maintain the screen 30 in a recoiled and contracted state within the housing 110 to provide a normal window opening, or at a user's discretion, the screen 30 may be extended from the retractable barrier assembly 40 to the sill plate 25 by drawing upon the stiffener portion 50 of the screen 30 and engaging the retainer assemblies 90 by aligning and engaging the retainer tabs 92 and grooves 98 to cover the window opening with the screen 30. The retainer tabs 92 are held within the grooves 98 due to the tension applied to the screen 30 by the retractable barrier assembly 40. Furthermore, the engagement of the retainer assemblies 90 act to bias the stiffener edge 50 and the screen 30 toward and against the second weather strip 80 of each outer flange 122*a*, 122*b*.

Finally, the retainer assemblies 90 may remain engaged at all times if it is desired to provide automatic extension of the screen 30 to cover the window opening each time the lower window sash 20*a* is raised.

When it is no longer desired to have the screen 30 in an extended state, a user pulls on the stiffener edge 50 to disengage the retainer assemblies 90 to allow the screen 30 to retract back into the housing 110 via the tension of the retractable barrier assembly 40.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the window 10, it would be installed as indicated in FIG. 1.

The method of installing and utilizing the window 10 may be achieved by performing the following steps: acquiring a model of the window 10 having height and width dimensions which match an intended framed window opening; installing the window 10 as a sliding window unit in a conventional manner; allowing the bottom seal 60 and first weather strip 70 to form a proper connection between the lower window sash 20*a* and sill plate 25; opening the lower window sash 20*a* and extending the screen 30 from the housing 110 by pulling downwardly upon the stiffener edge 50 and engaging the retainer assemblies 90 to fence off the window opening with the screen 30; allowing the retainer assemblies 90 to force the stiffener edge 50 and screen 30 against the second weather strips 80 of the outer flanges 122*a*, 122*b*; disengaging the retainer assemblies 90, if desired, to allow the retractable barrier assembly 40 to retract the screen 30 into the housing 110 when the use of the screen 30 is no longer desired; removing the containment plate 100 when the need arises to perform maintenance upon the screen 30 and/or retractable barrier assembly 40 by removing the attaching fasteners 200 to access the retractable barrier assembly 40; motioning the first bracket 152*a* away from the spool 160 to disengage the axle portion 150 and enable removal of the retractable barrier assembly 40 and screen 30 portions; removing and replacing the screen 30 and/or the retractable barrier assembly 40, as required; replacing the retractable barrier assembly 40 between the brackets 152*a*, 152*b*; and, benefiting from a discreet method of installing a screen portion 30 within a window opening with an integrated screen 30 mechanism afforded a user of the present invention 10.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A retractable barrier assembly adapted for a sliding sash window system, comprising:

a housing having a top wall, a front wall, a rear wall, a first lateral wall, and a second lateral wall conjoined to form an opening opposing said top wall and defining a cavity region within said walls, wherein:

said housing is substantially rectangular; and, said rear wall extends in length more towards said opening than said front wall;

a retractable barrier assembly mounted within said housing having a screen affixed to a spool and configured to permit extraction of said screen from said spool and automatically wind said screen about said spool;

a containment plate, comprising:

a planar bar having an upper surface and a lower surface;

a first appendage extending perpendicularly from said upper surface; and, a second appendage extending perpendicularly from said upper surface;

wherein said second appendage is curvilinear;

wherein said containment plate is configured to insert into said cavity region and cover and conceal said retractable barrier assembly;

wherein said first appendage is affixed to an inside surface of said rear wall; and, wherein said second appendage is configured to form a slot between said second appendage and said front wall through which said screen extends;

a stiffener edge disposed on a distal end of said screen;

a retainer assembly, comprising:

at least one complementary pair of interlocking retainers;

wherein an individual retainer is affixed to said stiffener edge and another individual retainer is affixed to an ancillary structure.

2. The assembly recited in claim 1, wherein said first appendage is affixed at an obtuse angle with said planar bar and said second appendage is affixed at an acute angle with said planar bar so as to force said planar bar to form an acute angle with respect to said top wall when said containment plate is affixed to said housing.

3. The assembly recited in claim 1, wherein said containment plate is removably affixed to said housing.

4. The assembly recited in claim 1, wherein said retractable barrier is removably mounted to said housing.

5. The assembly recited in claim 1, further comprising a seal disposed on said lower surface.

6. The assembly recited in claim 1, further comprising a weather strip disposed on said stiffener edge.

7. A sliding sash window system, comprising:

a quadrilateral frame having an interior side and an exterior side, wherein:

said exterior side has a first inner flange and a second inner flange along opposing portions thereof; and, said interior side has a first outer flange and a second outer flange along opposing portions thereof;

at least one sash, each positioned within said inner flanges and said outer flanges and configured to facilitate friction-type sliding within said quadrilateral frame;

at least one housing, each having a top wall, a front wall, a rear wall, a first lateral wall, and a second lateral wall conjoined to form an opening opposing said top wall and defining a cavity region within said walls, wherein:

each housing is substantially rectangular;

said rear wall extends in length more towards said opening than said front wall; and, an individual housing is affixed to an edge of an individual sash and is configured to fit between said inner flanges and said outer flanges;

a retractable barrier assembly mounted within each housing, each having a screen affixed to a spool and configured to permit extraction of said screen from said spool and automatically wind said screen about said spool;

a containment plate for each housing, each containment plate comprising:

a planar bar having an upper surface and a lower surface;
a first appendage extending perpendicularly from said upper surface; and,
a second appendage extending perpendicularly from said upper surface;
wherein said second appendage is curvilinear;
wherein said containment plate is configured to insert into said cavity region and cover and conceal said retractable barrier assembly;
wherein said first appendage is affixed to an inside surface of said rear wall; and,
wherein said second appendage is configured to form a slot between said second appendage and said front wall through which said screen extends;
a stiffener edge disposed on a distal end of at least one screen;
a retainer assembly for each retractable barrier assembly, each comprising:
at least one complementary pair of interlocking retainers;
wherein an individual retainer is affixed to an individual stiffener edge and another individual retainer is affixed to said quadrilateral frame;
wherein said housing is configured to be coextensive with said sash to which it is affixed so as to enable sliding of said sash and said housing within said quadrilateral frame;
wherein extraction of said screen through said slot enables extension of said screen from said sash within said quadrilateral frame and retention of said screen in place via said retainer assembly; and,
wherein said retainer assembly enables said screen to create a barrier extending from said sash to said interlocking retainer.

8. The assembly recited in claim 7, wherein at least one containment plate has said first appendage affixed at an obtuse angle with said planar bar and said second appendage affixed at an acute angle with said planar bar so as to force said planar bar to form an acute angle with respect to said top wall when said containment plate is affixed to an individual housing.

9. The system recited in claim 7, wherein at least one containment plate is removably affixed to an individual housing.

10. The system recited in claim 7, wherein at least one retractable barrier is removably mounted to an individual housing.

11. The system recited in claim 7, further comprising a seal disposed on at least one lower surface.

12. The system recited in claim 7, further comprising a weather strip disposed on at least one stiffener edge.

13. The system recited in claim 7, wherein at least one housing is removably affixed to an individual sash.

14. A sliding sash window system, comprising:
a quadrilateral frame having an interior side and an exterior side, wherein:
said exterior side has a first inner flange and a second inner flange along opposing portions thereof;
said interior side has a first outer flange and a second outer flange along opposing portions thereof; and,
said first and second outer flanges are each provided with a weather strip along peripheral edges thereof;
at least one sash, each positioned within said inner flanges and said outer flanges and configured to facilitate sliding within said quadrilateral frame;
at least one housing, each having a top wall, a front wall, a rear wall, a first lateral wall, and a second lateral wall conjoined to form an opening opposing said top wall and defining a cavity region within said walls, wherein:
each housing is substantially rectangular;
said rear wall extends in length more towards said opening than said front wall; and,
an individual housing is affixed to an edge of an individual sash and is configured to fit between said inner flanges and said outer flanges;
a first bracket disposed on an inner surface of said first lateral wall;
a second bracket disposed on an inner surface of said second lateral wall;
a retractable barrier assembly for each housing, each comprising:
an axle mounted to at least one of said first bracket and said second bracket;
a spool rotatingly engaged with said axle;
a torsion spring disposed within said spool having a first end affixed to said axle and a second end attached to said spool; and,
a screen affixed to said spool;
wherein said retractable barrier assembly is configured to permit extraction of said screen from said spool and automatically wind said screen about said spool;
a containment plate for each housing, each containment plate comprising:
a planar bar having an upper surface and a lower surface;
a plurality of drain apertures disposed within said planar bar;
a first appendage extending perpendicularly from said upper surface; and,
a second appendage extending perpendicularly from said upper surface;
wherein said second appendage is curvilinear;
wherein said containment plate is configured to insert into said cavity region and cover and conceal said retractable barrier assembly;
wherein said first appendage is affixed to an inside surface of said rear wall; and,
wherein said second appendage is configured to form a slot between said second appendage and said front wall through which said screen extends;
a stiffener edge disposed on a distal end of at least one screen, each comprising:
a first stiffener half; and,
a second stiffener half;
wherein said first stiffener half and said second stiffener half conjoin to entrap said screen via post and socket features of said stiffener edge; and,
wherein said stiffener edge is configured to provide rigidity to said screen, provide a handle to grasp said screen, and prevent said screen from retracting into said cavity region;
a retainer assembly for each retractable barrier assembly, each comprising:
at least one complementary pair of interlocking retainers, each comprising:
a male retainer having a retainer post affixed to an end of an individual stiffener edge and a protruding retainer tab;
a female retainer having an anchor affixed to said quadrilateral frame and a protruding groove portion; and,
wherein said groove portion is configured to receive and center said retainer tab upon engagement with said retainer tab;

wherein said housing is configured to be coextensive with said sash to which it is affixed so as to enable sliding of said sash and said housing within said quadrilateral frame;

wherein extraction of said screen through said slot enables extension of said screen from said sash within said quadrilateral frame and retention of said screen in place via said retainer assembly due to tension being applied to said screen by said retractable barrier assembly;

wherein said retainer assembly enables said screen to create a barrier extending from said sash to said interlocking retainer;

wherein each weather strip is positioned to face toward said sash and abut against said sash, said screen, and said stiffener edge when said screen is extended from said sash;

wherein each retainer assembly is configured to bias said screen and said stiffener edge against each of said weather strip; and, wherein each of said weather strip is configured to provide a mechanical bond to said screen.

15. The assembly recited in claim 14, wherein at least one containment plate has:

said first appendage affixed at an obtuse angle with said planar bar and said second appendage affixed at an acute angle with said planar bar so as to force said planar bar to form an acute angle with respect to said top wall when said containment plate is affixed to an individual housing;

wherein said drain apertures are arranged along said planar bar in close proximity to said second appendage.

16. The system recited in claim 14, wherein at least one containment plate is provided with fasteners enabling removable affixment to an individual housing.

17. The system recited in claim 14, wherein at least one of said first bracket and second bracket comprises a resilient material to enable lateral deflection thereof to allow removable mounting of an individual retractable barrier assembly.

18. The system recited in claim 14, further comprising a seal disposed on at least one lower surface.

19. The system recited in claim 14, further comprising a weather stripping disposed on at least one stiffener edge.

20. The system recited in claim 14, wherein at least one housing is provided with fasteners enabling removable affixment to an individual sash.

* * * * *